United States Patent [19]

Körner et al.

[11] 3,985,988

[45] Oct. 12, 1976

[54] ELECTRIC CIRCUIT BREAKER ASSEMBLY

[75] Inventors: Gerhard Körner, Schriesheim; Wolfgang Schmitz, Affolterbach, both of Germany

[73] Assignee: BBC Brown Boveri & Cie AG, Mannheim, Germany

[22] Filed: Sept. 30, 1974

[21] Appl. No.: 510,717

[30] Foreign Application Priority Data

Oct. 1, 1973 Germany ..... 2349263

[52] U.S. Cl. ..... 200/148 R; 200/148 A; 200/150 E; 200/150 G

[51] Int. Cl.[2] ..... H01H 33/70

[58] Field of Search ..... 200/148 R, 148 A, 150 E

[56] References Cited

UNITED STATES PATENTS

| | | | |
|---|---|---|---|
| 2,420,889 | 5/1947 | Leeds | 200/150 E |
| 2,452,477 | 10/1948 | Leeds | 200/150 E |
| 2,488,569 | 11/1949 | Strom | 200/150 E |

*Primary Examiner*—Robert S. Macon

*Attorney, Agent, or Firm*—Toren, McGeady and Stanger

[57] ABSTRACT

A circuit breaker assembly is provided with a pair of contact elements defining therebetween an arc site across which an arc is struck upon separation of the contacts to break the circuit within which the breaker is connected. A compressed gas contained within a quenching chamber is caused to flow across the quenching site to quench the arc upon breaking of the contact. A pair of electrodes located within an auxilliary gas chamber operate to strike a second arc simultaneously with the circuit breaking operation in order to increase pressure in the auxiliary chamber thereby providing auxiliary power to enhance the circuit breaking operation and quenching of the main arc.

21 Claims, 6 Drawing Figures

ELECTRIC CIRCUIT BREAKER ASSEMBLY

BACKGROUND OF THE INVENTION

The present invention relates generally to electrical circuit breakers wherein a compressed gas is utilized to quench the arc which occurs across the contact elements of the breaker during separation thereof. More particularly, the invention relates to a circuit breaker wherein an internal duct is defined through at least one of the contact elements to define a flow path through which the quenching gas may flow during the quenching operation.

An electric circuit breaker has become known in the art operating in accordance with a compression system in which the flow of the quenching gas is generated by means of a system including bellows and a piston. The system is provided with a stationary contact having a nozzle-like internal duct and a movable contact element, with a cylinder arrangement being provided at the movable contact element which is interconnected by means of a duct with the quenching chamber in which the quenching site is situated. The cylinder area is engaged by a piston which, with respect to the stationary contact element, is, in principle, stationary. Upon breaking of the circuit, the movable contact element jointly with the cylinder system is removed from the stationary contact element, and the amount of gas situated within the cylinder system is compressed by the system of the bellows and the piston, and is thus rapidly fed to the quenching site.

A problem resulting in the operation of this device is that the device for driving the breaker must actuate not only the movable contact element but also the cylinder system of the piston and bellows arrangement. This means that the masses which must be moved are very great, thereby requiring elevated driving power.

Moreover, there is known in the art an electrical circuit breaker having a piston and bellows arrangement wherein two opposite contact elements are provided with internal ducts designed as nozzles tightly surrounded by a movable contact system. The two contact elements and the contact system itself are surrounded by a blasting cylinder serving to generate flow of quenching gas. In the course of the breaking motion, the blasting cylinder connected with the movable contact system is moved over a stationary blasting piston and the occluded quenching gas is rapidly compressed. The powerful gas flow occurring following contact breaking blasts the arc which must however be reversed on the two stationary contact elements. It is particularly this last-mentioned feature that constitutes one of the major drawbacks of such a system, in view of the fact that communication entails particular problems. Moreover, the hermetic connection of the one stationary contact element with the movable contact system causes problems. In addition, the simultaneous actuation of the blasting cylinder and of the movable contact system requires relatively high driving power.

The present invention is aimed toward an electric circuit breaker of the type described above which would obviate the drawbacks of circuit breakers known in the art. In particular, the invention is directed toward reducing the driving power required for the movable contact element and for the blasting piston arrangement.

SUMMARY OF THE INVENTION

In accordance with the invention, there is provided at one of the two contact elements, means to generate, upon switching, a second arc in series with the main arc caused by the circuit breaking operation, said second arc being struck within a combustion or auxiliary chamber situated outside the cylinder and piston system. By elevation of temperature, the pressure of the gas within the combustion chamber, is increased to such an extent that there is provided an assist to the mechanical power of the breaker drive mechanism to the level required for the quenching of current intensities substantially up to the rated current of the breaker in such a way that the blasting of the contact quenching site is adequate for the breaking of the rated breaking current.

In the arrangement of the invention, a piston and cylinder system is provided with the cylinder surrounding the contact quenching site being connected with the driving device. Moreover, the piston is designed as a piston head attached to the movable contact element, with the movable contact element being connected with the cylinder, if indicated, by means of at least one spring and/or damping element.

If the auxiliary or combustion chamber of the second arc is hermetically separated from the inner chamber of the cylinder, the mode of operation of the circuit breaker is such that if the movable contact element is brought into breaking position, the stationary contact element trails the movable contact element over a short distance. In the process, an arc is struck between two ring electrodes located within the auxiliary chamber, which, because of the design of the two ring electrodes, moves in a revolving path. The arc moves along its longitudinal axis with respect to the initially inert gas in such a way as to cause a cross-blasting effect. As a result, the gas inside the auxiliary chamber is heated and exerts pressure from the outside against the bottom of the cylinder. In the meantime, the movable contact element jointly with the cylinder continue to advance toward the breaking position. Through the pressure prevailing at that time, the movement of the cylinder, with respect to the breaking motion, is assisted even further. To prevent gas from flowing out of the auxiliary chamber at that time, the outside diameter of the cylinder is formed identical to the inside diameter of the housing of the breaker, sealing elements being provided between the two wall surfaces.

The pressure generated in the quenching chamber acts upon the piston arranged at the movable contact element, and, following the releasing of a mechanical lock, urges the movable contact element toward the quenching position. Following quenching of the arc, the remaining residual pressure moves the movable contact element into breaking position.

In another embodiment of the invention the movable contact has connected thereto a molded element defining an aperture enveloping the contact quenching site. In this arrangement, the aperture is designed in the form of a nozzle and permits the gas situated in the quenching chamber to flow not only through the internal duct of the movable contact element, but also through the aperture into a space outside the quenching chamber arrangement. The flow of gas divides into two partial currents. For the purpose of assisting the drive of the movable contact element, there are provided electrodes operable to strike therebetween upon a breaking action the second arc for the purpose of generating increased pressure. For this purpose, a piston is provided at the movable contact element and a stationary wall is arranged between the cylinder bottom and the piston with the electrodes being situated between the wall and the piston. Upon breaking, the pressure and temperature within the auxiliary chamber are increased and, as a result, the movable contact element is driven into breaking position.

As a rule, in the case of low currents the buildup of pressure by the second arc is small, and the flow of quenching gas and the buildup of pressure to actuate the movable contact element is rather weak on account of high counterforces. However, the drive itself is adequate for low currents. Thus, the drive is dimensioned in such a way that the pressure built up by it in the quenching chamber is adequate for the quenching of low currents and there is, therefore, no need for an assist from the second arc. Accordingly, with low currents such an assist is not provided. However, the cycle of movement is slowed down, and to obviate this drawback, valves are provided in the cylinder bottom to permit a discharge of gas during a breaking operation such that the compressive force built up inside the quenching chamber does not cause an arresting of the cylinder.

If high currents appear, the second arc generates a very high pressure in the auxiliary chamber, which assists the driving force for the cylinder and thereby generates a high compression in the quenching chamber.

The design in which the cylinder is provided with the nozzle-like aperture is used, essentially, with high voltage circut breakers. The particular advantage of all of these arrangements resides in the fact that the driving power for the movable contact element and for the blasting piston has, on the whole, been reduced by comparision with known devices.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
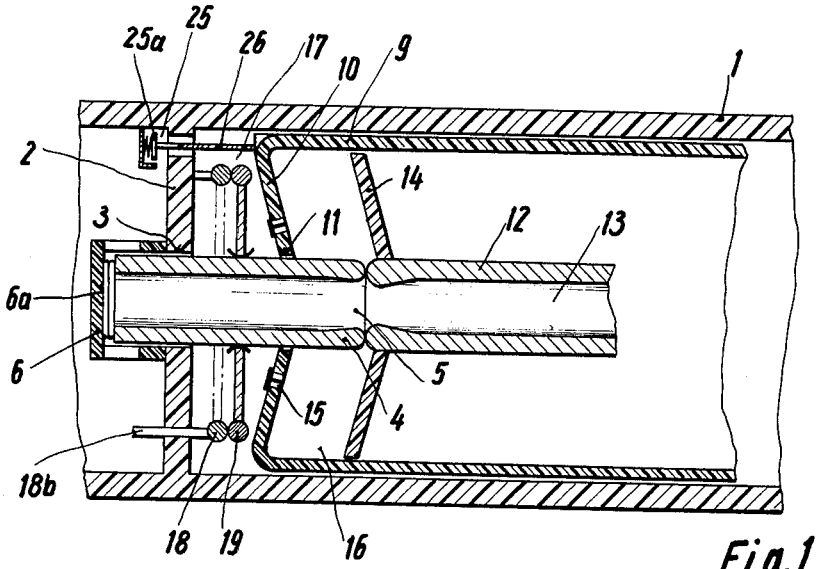
FIGS. 1 and 2 are sectional views showing an embodiment of the invention in its contact-closed and in its quenching positions, respectively.
Figure 2:
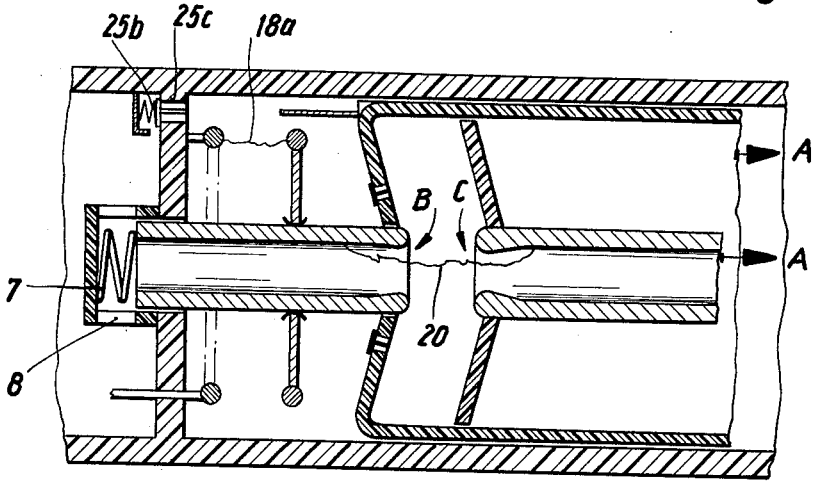

Referring now to the drawings, wherein like reference numerals refer to similar parts throughout the various figures thereof, there is shown in FIGS. 1 and 2, an electric circuit breaker provided with a housing 1 having a partition 2 wherein an opening 3 traversed by a stationary contact element 4 is provided. The stationary contact element 4 is provided with an internal duct

5. On a side of the partition 2 opposite the quenching site of the breaker, there is arranged a cupped molded element 6, having a pair of openings 8, enveloping the extremity of the stationary contact element 4 penetrating the partition 2. Between the bottom **6*a* of element 6 and the stationary contact element 4 there is provided a spring 7 biasing the contact element 4** toward an operating position in the direction of the arrrow A.

The quenching site is surrounded by a cylinder 9 which is pulled during a breaking operation in the direction of arrow A by means of a drive mechanism (not shown). The bottom 10 of the cylinder 9 has a recess 11 whose inside diameter corresponds substantially to the outside diameter of the stationary contact element 4. Within the cylinder 9 there is arranged a movable contact element 12 provided with a nozzle-shaped interior duct 13. At the terminal secton adjoining the contact quenching site, a partition 14 is arranged on the movable contact element 12. In the bottom 10 of the cylinder 9 there are provided valve means 15 permitting gas situated in a quenching chamber 16 upon breaking of low currents to exit from the quenching chamber 16 if the pressure differential between the quenching chamber 16 and a combustion or auxiliary chamber 17 is excessive. It should be noted that the stationary contact element 4 is designed as a follower contact element which, in a braking action, follows the movable contact element 12 over a short distance.

The auxiliary chamber 17 is defined within the space situated between the partition 2 and the bottom 10 of the cylinder 9. The chamber 17 accommodates therein two opposite, annular or ring electrodes 18 and 19, which, as can be seen from FIG. 2, are movable relative to one another and between which an arc **18*a* is struck during a breaking operation. It is possible to fixedly connect the electrode 19 with the stationary contact element 4. Another possibility would be to allow the electrode 19 to run independently of the movement of the contact elements by means of a spring against an abutment. FIGS. 1 and 2** do not illustrate the fixed connection, rather, they show the variant in which the movement is independent. For the sake of clarity, the spring and the abutment are omitted from the drawing.

In the operation of the circuit breaker according to FIGS. 1 and 2, if a weak current is to be broken, the cylinder 9 is pulled initially in the direction of the arrow A, thereby compressing the gas situated in the space 16. At the same time, this movement is followed by the ring electrode 19 designed as a movable electrode, which strikes a secondary arc **18*a*. The drive is now designed in such a way that it is unable to compress all of the gas situated in the chamber 16. However, in view of the fact that, after covering a certain distance, the pressure inside the chamber 16 became so high that the drive is no longer capable of overcoming it, valves 15 are provided, which allow the gas to exit from the quenching chamber and thereby provide pressure compensation. The secondary arc 18*a* revolves due to the shape of the two ring electrodes 18 and 19, but it is not powerful enough to heat the gas in the auxiliary chamber 17 sufficiently to cause a marked rise in pressure. Therefore, because a pressure cushion is unable to form in the chamber 16, the drive continues to pull the cylinder. By means of coupling elements, such as, for instance, springs or shock absorbers, the movable contact element 12 is connected with the cylinder 9. As a result, the movable contact element 12 proceeds jointly with the cylinder 9 into quenching position, and the arc 20 is now struck between the two contact elements 4 and 12. The arc 20 is blasted by compressed gas situated inside the quenching chamber 16, with the gas being discharged in the direction of the arrows B and C through the interior ducts 5 and 13. Following the quenching cycle (FIG. 2**) the circuit breaker is brought into breaking position.

To return the circuit breaker into making position, two additional value elements 25 are arranged in the partition 2 which, by means of a ram 26 situated at the cylinder 9, are controlled in such a way as to prevent the occurrence inside the chamber 17 of an overpressure or of an air cushion preventing a making operation.

In the case of a short-circuit break, there occurs, in principle, the same cycle. However, the arc 18*a* is so powerful that it heats the gas inside the chamber 17 to such an extent that the pressure assists the drive of the cylinder in such a way that the blasting of the contact quenching site by the gas compressed in the quenching chamber 16 suffices also for quenching the short-circuit current. In that case, the chamber 17, on account of the design of the valves 15, is hermetically separated from the quenching chamber 16 proper, and there does not occur any blasting of the arc by hot gases coming from the chamber 17.

Instead of coupling the movable contact element directly with the cylinder 9, the drive of the contact element 12 may be effected by utilizng the rise in pressure occurring within the quenching chamber. For that purpose, means are required to provide a controlled movement of the movable contact element. For example, linkages can be provided which are controlled by cams arranged at the drive of the "bellows"-type cylinder. Such rod linkage may then control the movement of the movable contact element. For the sake of clarity, this arrangement is, however, not shown in the drawing.

Figure 3:
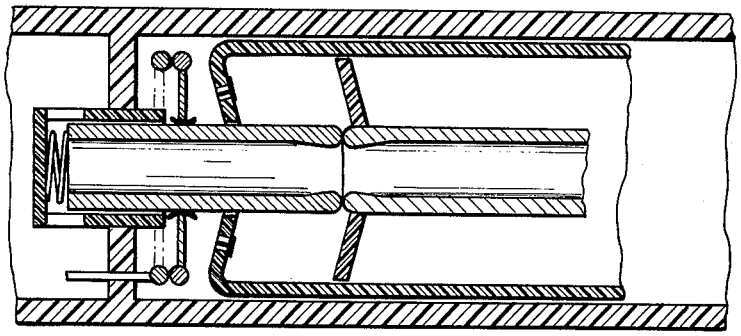
FIGS. 3 and 4 are sectional views similar to FIGS. 1 and 2 showing a modification of the embodiment depicted therein.
Figure 4:
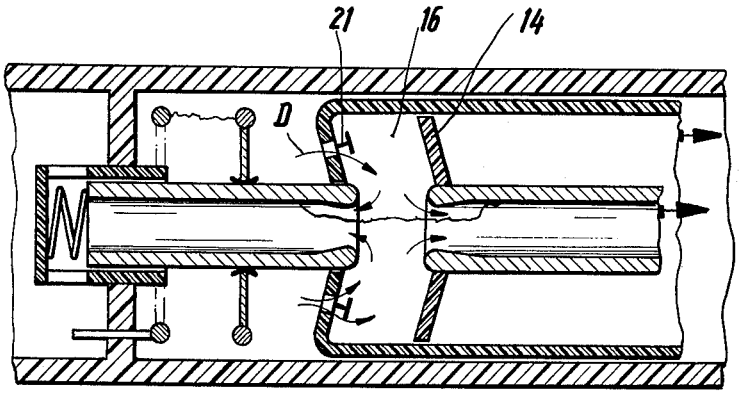

In the modification illustrated in FIGS. 3 and 4, the bottom 10 of the cylinder 9 is provided with valves 21 which permit gas at elevated current to exit from the combustion chamber 17 into the actual quenching chamber 16 during a breaking operation. In this case, the circuit arc to be quenched is also blasted by gas effluent emanating from the combustion chamber in the direction of the arrow D. The diameter of the housing 1 as well as the diameter of the cylinder 9 can be considerably reduced by comparison with the design according to FIGS. 1 and 2, and the drive is capable of compressing the quenching chamber volume designed for the quenching of low currents. There does not occur any outflow of gas from the combustion chamber because, in the case of low currents, the gas in the combustion chamber has not been intensively heated.

Figure 5:
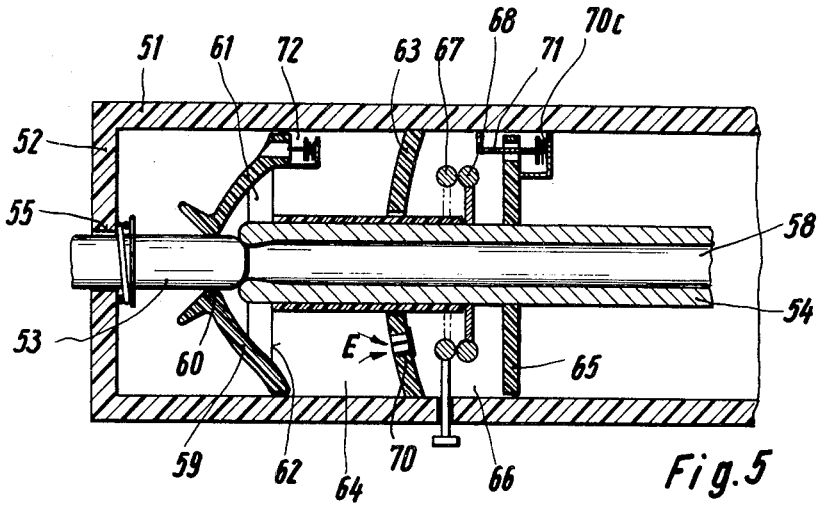
FIGS. 5 and 6 are sectional views showing another embodiment of the invention in the contact-closed and quenching positions, respectively.
Figure 6:
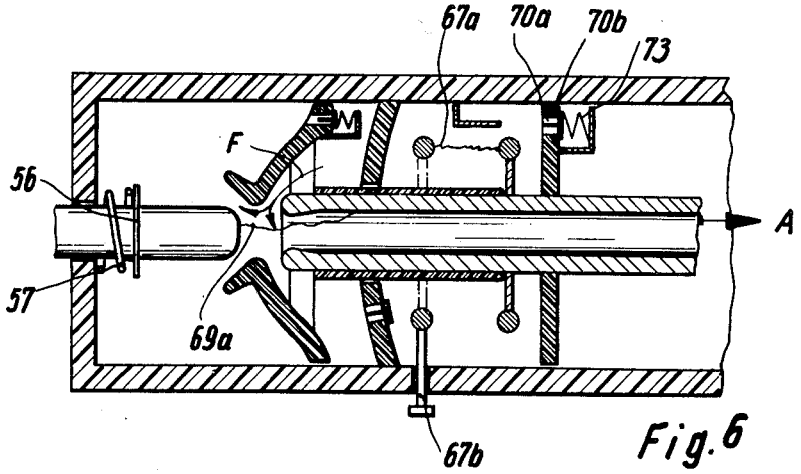

A further embodiment of the invention is illustrated in FIGS. 5 and 6, wherein a housing 51 closed off by an end wall 52 has situated therein a stationary contact element 53 and a movable contact element 54. The stationary contact element 53 traverses a recess 55 in the end wall 52 and is provided with a pressure plate 56, with a compression spring 57 arranged between the end wall and the pressure plate 56 biasing the stationary contact element 53 toward the breaking direction indicated by the arrow A.

The stationary contact element 53 is designed as a tripping pin and follows in a breaking operation the movable contact element 54. The contact element 54 is provided with an interior duct 58 and at one end thereof there is mounted a molded element 59 defining a nozzle-like aperture 60. The molded element 59 is attached to the movable contact element 54 by means of a carrier ring 62 provided with passage apertures 61. On the breaker housing 51 there is stationarily mounted a partition 63 with a quenching chamber 64 being defined between the molded element 59 and the partition 63. Outside the quenching chamber 64, a piston head 65 is provided at the movable contact element 54, with the space between the partition 63 and the piston head 65 being defined as an auxiliary chamber 66 within which there are provided two opposite ring electrodes 67,68, electrode 67 being stationary and insulated with respect to the movable contact element 54 and electrode 68 being connected with the movable contact element 54.

In the operation of the breaker in accordance with FIGS. 5 and 6, during a breaking action for weak currents, the movable contact element 54 is pulled in the direction of the arrow A. As a result, the gas situated in the chamber 64 is compressed and, as illustrated in FIG. 6, a secondary arc 67*a* is struck between electrodes 67,68. The arc 67*a* has a very low energy so that the temperature is inadequate to excessively increase the gas pressure in the auxiliary chamber 66. In view of the fact that the stationary contact element 53 is designed as a follower element, the arc 67*a* will at all times be formed first. Now if the pressure arising inside the chamber 64 becomes excessive, the drive would no longer be adequate. For that purpose, valve means 70 are provided in the wall 63 permitting the gases during such a breaking action to exit in the direction of the arrow E through the openings 63 into the chamber 66.

Before breaking of the circuit, an arc 69*a* is struck between the stationary and the movable contact elements 53 and 54 and the gas situated in the chamber 64 flows out in the direction F through the passage openings 61 both into the interior duct 58 and through the nozzle-like aperture 60 into the chamber between the molded piece 59 and the end wall 52. The blasting of the arc now occurs in the nozzle-like interior ducts 58 and in the nozzle-like opening 60. The so-called quenching position is illustrated in FIG. 6. The moment the arc 69*a* has been quenched, the movable contact element proceeds to advance toward the breaking position.

Upon the occurrence of heavy currents, breaking occurs in identical manner but the power of the arc 67*a* is so great that it increases the temperature and therefore the pressure of the gas inside the auxiliary chamber 66 to such an extent that the blasting of the contact quenching site suffices also for the quenching of the rated breaking current. As a result of the intense rise in pressure, the drive for the movable contact element 54 is markedly assisted, thereby achieving an adequate quenching of the arc. The valves 70 which can be designed as nonreturn valves, are closed by the pressure difference prevailing between the chambers 64 and 66, thereby preventing gas in the chamber 66 from penetrating the quenching chamber 64.

For the purpose of a making operation, valves 70*a* must be provided in the piston heads 65, which valves are kept open in the connected state by means of a ram 71 mounted to the inside of the housing 51. Likewise, valves 72 are provided at the molded element 59 which, although open when contact is made, are immediately closed because of the prevailing pressure occurring upon the onset of a breaking action. As a result, there is prevented the creation during a contact closing operation of a pressure cushion in the space between the molded element 59 and the end wall 52 as well as in the space between the piston head 65 and the partition 63 which would prevent contact from being made. In this context it should be noted that the valve 71 is opened in contact-making position by the ram 71 counter to the pressure of a spring 73 and, in the case of a contact-breaking action, as illustrated in FIG. 6, is brought into closing position under the pressure of the spring 73 to prevent any outflow through the valve 70 in the event of the occurrence of overpressure in the auxiliary chamber 66.

In all of the cases described, the ring electrodes are designed in such a way that they cause the arc to rotate within the auxiliary chamber. As a result, all points of the auxiliary chamber are heated uniformly so that the average temperature can rapidly attain adequate values. This can be achieved, for example, with the electrodes designed as coils actuating the arc. This holds true also in those cases in which the arc runs radially of the breaker casing as would occur if the stationary electrode were mounted on the inside wall of the circuit breaker casing. However, the arrangement in which the axis of the arc runs parallel to the axis of the circuit breaker appears to be preferable because, in this case of the radical course of the arc, it is necessary to take into account different base speeds and such a drawback could be obviated only at increased cost.

It holds furthermore that, in all instances, the secondary arc serving to increase the pressure must be situated in series with the actual circuit-breaking arc, so that the moment the circuit-breaking arc has been quenched, the secondary arc will likewise disappear. For that purpose, each stationarily arranged ring electrode has its own current supply. In FIGS. 1–4, the ring electrode 18 has a current supply **18*b* extending through the partition 2, and in FIGS. 5,6 the ring electrode 67 has a current supply 67*b* provided through the housing 51**.

The valves 25, designed to close an opening **25*c*, have a valve disk 25*a* which, under the pressure of a spring 25*b*, is compressed in circut-breaking position against the opening 25*c* and closes same. The moment the circut breaker is brought into the circuit-making position, the ram 26 pushes against the valve disk 25*a*, thereby opening the valve 25. In the quenching position, the spring 25*b* is so strong that the excess pressure prevailing in the chamber 17 as a result of the arc 18*a* cannot open the valve 25** not even if a short-circuit current is passed.

The same holds true also for the valve **70*a* since in this case the power of the spring 73 acting on a valve disk 70*c* closing the opening 70*b* is so great that, even in the event of occurrence of a short-circuit current, the pressure is inadequate to overcome the force of the spring 73**.

While specific embodiments of the invention have been shown and described in detail to illustrate the application of the inventive principles, it will be understood that the invention may be embodied otherwise without departing from such principles.

What is claimed is:

1. An electrical circuit breaker assembly comprising, in combination, a pair of contact elements movable relative to each other to effect making and breaking of a circuit having said circuit breaker assembly connected therein, said contact elements having defined therebetween an arc site through which a circuit breaking arc is struck between said contact elements upon breaking of said circuit, means defining an arc quenching chamber surrounding said arc site, an arc quenching gas contained within said arc quenching chamber, means for passing said arc quenching gas out of said arc quenching chamber and across said arc site to quench an arc struck between said contact elements upon breaking of said circuit, means defining an auxiliary chamber having a gas contained therein, electrode means comprising at least one pair of electrodes movable relative to each other located within said auxiliary chamber with each of said electrodes having an annular configuration and being arranged concentrically about one of said contact elements, means for imparting to at least one of said contact elements a force derived from pressure within said auxiliary chamber tending to move said contact elements relative to each other in a circuit breaking direction, means for connecting said electrode means within said circuit in series with said contact elements, and means for moving said at least one pair of electrodes relative to each other in association with said contact elements, said electrodes being in abutting relationship when said contact elements are in abutting relationship to close said circuit, with separation of said electrodes to effect striking of a secondary arc thereacross occurring simultaneously with separation of said contact elements, said electrodes being shaped to cause said secondary arc to move while being struck therebetween along a generally annular path coincident with said annular configuration of said electrodes around said one of said contact elements, said secondary arc when of sufficient magnitude being operative to increase pressure in said auxiliary chamber to impart to said contact elements a force derived from said increased auxiliary chamber pressure assisting movement of said contact elements in a circuit breaking direction thereby to provide power for quenching of current intensities through said circuit breaker substantially to the level of rated current therethrough in order to ensure quenching of an arc at said arc site sufficient to effect cutoff of rated current through said breaker.

2. An assembly according to claim 1 wherein said means defining said arc quenching chamber include a cylinder member and a piston member enclosing said quenching site, said piston being fixed relative to one of said contact elements.

3. An assembly according to claim 2 including damping means connecting said cylinder member to said one contact element.

4. An assembly according to claim 1 including a housing having an inner diameter enclosing said assembly, said cylinder member having an outer diameter corresponding to the inner diameter of said housing whereby said cylinder member may be guided thereby for movement within said housing.

5. An assembly according to claim 4 wherein said housing includes an end wall and wherein said cylinder member includes a bottom wall, said auxiliary chamber being defined between said housing end wall and said cylinder bottom wall.

6. An assembly according to claim 4 including sealing means located between said cylinder outer diameter and said housing inner diameter to prevent gas flow from said auxiliary chamber to between said housing and said cylinder member.

7. An assembly according to claim 5 wherein said cylinder member includes a side wall which together with said cylinder bottom wall defines a cylinder inner volume, said auxiliary chamber being hermetically separated from said inner volume of said cylinder member.

8. An assembly according to claim 1 including valve means located between said arc quenching chamber and said auxiliary chamber, said valve means being operable to permit gas flow only from said arc quenching chamber into said auxiliary chamber while preventing gas flow from said auxiliary chamber into said arc quenching chamber.

9. An assembly according to claim 1 including valve means located between said arc quenching chamber and said auxiliary chamber, said valve means being operable to permit gas flow only from said auxiliary chamber into said arc quenching chamber while preventing gas flow from said arc quenching chamber into said auxiliary chamber.

10. An assembly according to claim 8 wherein said valve means consists of nonreturn valves.

11. An assembly according to claim 9 wherein said valve means consists of nonreturn valves.

12. An assembly according to claim 1 wherein said contact elements include a movable contact element and a follower contact element, said follower contact element being movable through a smaller path than said movable contact element during a breaking operation, and wherein said at least one pair of electrodes include a first electrode affixed to said follower contact element and a second electrode fixedly mounted within said auxiliary chamber.

13. An assembly according to claim 1 wherein said contact element includes a movable contact element and a follower contact element, said follower contact element being movable through a smaller path than said movable contact element during a breaking operation, and wherein said at least one pair of electrodes includes an electrode mounted upon said movable contact element.

14. An assembly according to claim 13 including a housing having an interior wall enclosing said breaker assembly, a molded element mounted upon said movable contact element, a partition wall extending from the interior wall of said housing, said partition wall and said molded element defining therebetween said arc quenching chamber, with said auxiliary chamber being defined exteriorly of said arc quenching chamber.

15. An assembly according to claim 14 including a piston member mounted upon said movable contact element on a side of said partition wall opposite said arc quenching chamber, said partition wall and said piston member defining therebetween said auxiliary chamber.

16. An assembly according to claim 14 wherein said molded element is configured to define a nozzle aperture surrounding said follower contact and arranged to define a flow path through which said arc quenching gas may flow to quench said arc during a circuit breaking operation.

17. An assembly according to claim 16 including a carrier ring mounted upon said movable contact element and supporting thereon said molded element, said carrier ring defining therethrough apertures for passage of said arc quenching gas.

18. An assembly according to claim 14 including valve means located in said partition wall and operable to permit gas flow only from said quenching chamber into said auxiliary chamber while preventing gas flow from said auxiliary chamber into said quenching chamber.

19. An assembly according to claim 15 including valve means extending through said piston member and adapted to be closed during a circuit breaking operation and opened during a circuit making operation.

20. An assembly according to claim 15 wherein said at least one pair of electrodes includes a movable electrode and a stationary electrode located between said partition wall and said piston member and arranged opposite one another, said movable electrode being mounted for movement with said movable contact element.

21. An assembly according to claim 1 wherein at least one of said contact elements is formed to define an internal duct through which said arc quenching gas may flow during quenching of said arc upon occurrence of a circuit breaking operation.

* * * * *